US006821392B2

(12) United States Patent
Filion

(10) Patent No.: US 6,821,392 B2
(45) Date of Patent: Nov. 23, 2004

(54) HEADBOX SEALING DEVICE

(75) Inventor: Daniel Filion, St. Jérôme (CA)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/370,661

(22) Filed: Feb. 20, 2003

(65) Prior Publication Data

US 2004/0163788 A1 Aug. 26, 2004

(51) Int. Cl.[7] ..... D21F 1/00; D21F 1/06

(52) U.S. Cl. ..... 162/336; 162/343; 162/345; 162/347; 162/203

(58) Field of Search ..... 162/336, 343, 162/344, 345, 347, 203

(56) References Cited

U.S. PATENT DOCUMENTS

| | | | | |
|---|---|---|---|---|
| 3,839,143 A | | 10/1974 | Suckow | |
| 3,972,771 A | * | 8/1976 | Notbohm | 162/343 |
| 4,050,499 A | | 9/1977 | Luey et al. | |
| 4,675,078 A | | 6/1987 | Reiner | |
| 5,035,773 A | | 7/1991 | Hollberg et al. | |
| 5,129,988 A | | 7/1992 | Farrington, Jr. | |
| 5,160,583 A | | 11/1992 | Eaton et al. | |
| 5,783,045 A | | 7/1998 | Santos et al. | |
| 5,798,024 A | | 8/1998 | Odell et al. | |
| 6,117,271 A | | 9/2000 | Page | |
| 6,146,500 A | | 11/2000 | Hada et al. | |

* cited by examiner

*Primary Examiner*—Peter Chin
*Assistant Examiner*—Mark Halpern
(74) *Attorney, Agent, or Firm*—Stiennon & Stiennon

(57) ABSTRACT

A pulp former's sealing blades extend between the headbox slice and twin forming wires and are bonded and/or pinned to blade supports which mount the blades to the slice. The blade supports have flat mounting surfaces which extend in the machine and cross machine directions and which overlie or underlie the blades supports. The blades may be affixed to the supports with an adhesive film. The supports are in turn mounted to the upper and lower sides of a pulp former headbox slice. After the adhesive bond is formed, holes are drilled through the flexible blades and into the blade supports. The holes are filled with pins which are mounted flush to the pulp side surfaces of the flexible blades. The holes through the flexible blades may be tapered, and the corresponding tapered portions of the pins may be used to clamp the flexible blades to the blade supports.

11 Claims, 3 Drawing Sheets

HEADBOX SEALING DEVICE

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to headboxes used in forming a fibrous web in general and to headboxes and forming sections of pulp formersin particular.

In the economy of papermaking the most basic asset is standing timber which can be harvested and made into paper. The process of turning standing timber into paper has many steps including harvesting the timber, reducing the logs harvested to wood chips, processing the wood chips to produce wood fiber, forming a paper sheet from the wood fibers, and finally finishing the paper by coating and calendaring the finished web. The value of the product formed increases as it is further processed. A given quantity of standing timber is of less value than logs ready for chipping, wood chips are less valuable than processed pulp fibers, and pulp fibers are less valuable than finished paper. At each stage of the process, value is added. As greater value is added to the natural resource—the standing timber—a greater investment in capital equipment is required. In many economies, the basic natural resources consumed are of relatively small value compared to the value added through labor and capital. In areas which are less developed in terms of the amount of capital available and the skills of the workforce, but which have access to plentiful natural resources, the economy may be more based on the harvesting and exporting of resources, such as timber.

The natural path of development for economies which have significant timber resources is to begin by exporting timber, and, through investment over time, to progress to the export of paper. This process is facilitated by a world economy which creates markets for intermediate products, from raw logs to wood chips, to wood pulp, to finished paper. Even within a developed economy which processes standing timber to finished paper, economies may dictate the buying and selling of the intermediate products between producers so that particular entities may specialize in buying logs and selling chips, or buying chips and selling pulp.

The manufacturing process for pulp requires that the pulp be handled as a suspension in water. Typically pulp for use in paper production will be contained in a stock containing about 96 percent water by weight. In papermaking, the stock is diluted further to about 99 percent water by weight and formed into a paper web by injecting the stock through a headbox onto a wire. A papermaking machine is a large capital intensive machine which must often be reconfigured between significantly different paper grades. If pulp is to be sold before it is manufactured into a paper web, either to avoid the capital cost of a papermaking machine or because the economics of a particular supplier dictates that the wood fibers be sold as fibers, the wood fibers must be concentrated to reduce the shipping cost associated with the water in which they are suspended. A specialized machine known as a pulp former has been developed which can remove approximately 95 percent of the water contained in a four percent fiber content stock, to produce a mat of fibers which is only 50 to 55 percent water. Further drying the mat is generally uneconomical because heated dryers would be required.

Unlike papermaking machines, which generally use very diluted stock, a pulp former operates with a pulp stock containing about four percent fiber dry weight. The unique properties of a pulp former present considerably different design problems and design solutions compared to a papermaking machine. In particular, a pulp former headbox is designed to keep the high fiber content stock fluid so that a uniform sheet can be formed between a pair of forming wires and uniformly dewatered on the forming table and through a series of press nips. The pulp former typically operates with forming wire speeds which are less than about five percent of the forming speed of a typical papermaking machine.

Existing pulp formers have been developed which use flexible stainless-steel blades which extend in the machine direction and the cross machine direction and extend from the lips of a pulp former slice into tangential engagement with that twin wires of a forming section of the pulp former. The flexible sealing blades extend just slightly past the tangent point of the forming rolls which support the forming wires of the pulp former. Pressure supplied by the pulp former headbox seals the flexible blades against the forming wires, preventing a pulp leak between the headbox of the forming wires which can result in an uneven web which presents problems in the pressing section of the pulp former. In known pulp formers, the flexible sealing blades have been sandwiched between a holder on the pulp side of the blades and the sealing blade supports which fix the blades to the headbox. Most recently, in order to avoid flow transitions, the use of a holder has been eliminated and the blades have been welded directly to the sealing blade supports. However welding the blades to the sealing blade supports presents manufacturing difficulties which can result in the blades warping due to the heat of welding. If the blades become warped than the pulp pressure may not be sufficient to seal the blades against the forming wires and thus the pulp may leak between the wires and the forming blades.

What is needed is a better way of mounting the sealing blades in a pulp former to the sealing blade supports which mount the sealing blades to the pulp former slice.

SUMMARY OF THE INVENTION

The pulp former of this invention employs a headbox wherein the sealing blades which extend between the headbox slice and the twin forming wires are bonded to blade supports which mount the blades to the headbox slice. The blade supports have flat mounting surfaces which extend in the machine and cross machine directions and which overlie or underlie the blades supports. An adhesive film between the flexible stainless-steel blades affixes the blades to the supports which are in turn mounted to the upper and lower sides of a pulp former headbox slice. After the adhesive bond is formed, holes are drilled through the flexible blades and into the blade supports. The holes are filled with pins which are mounted flush to the pulp side surfaces of the flexible blades. The pins serve to additionally supply shear resistance between the blades and blade supports. The flexible stainless-steel blades are relatively thin being approximately 1 to 1½ mm thick. The holes through the flexible blades may be tapered, and the corresponding tapered portions of the pins may be used to clamp the flexible blades to the blade supports.

It is an object of the present invention to provide a more reliable method for attaching flexible blades to the blades supports attached to the slice of a pulp former headbox.

It is another object of the present invention to provide a pulp forming headbox with more securely and uniformly attached flexible forming blades.

Further objects, features and advantages of the invention will be apparent from the following detailed description when taken in conjunction with the accompanying drawings.

DESCRIPTION OF THE PREFERRED EMBODIMENTS

Figure 1:
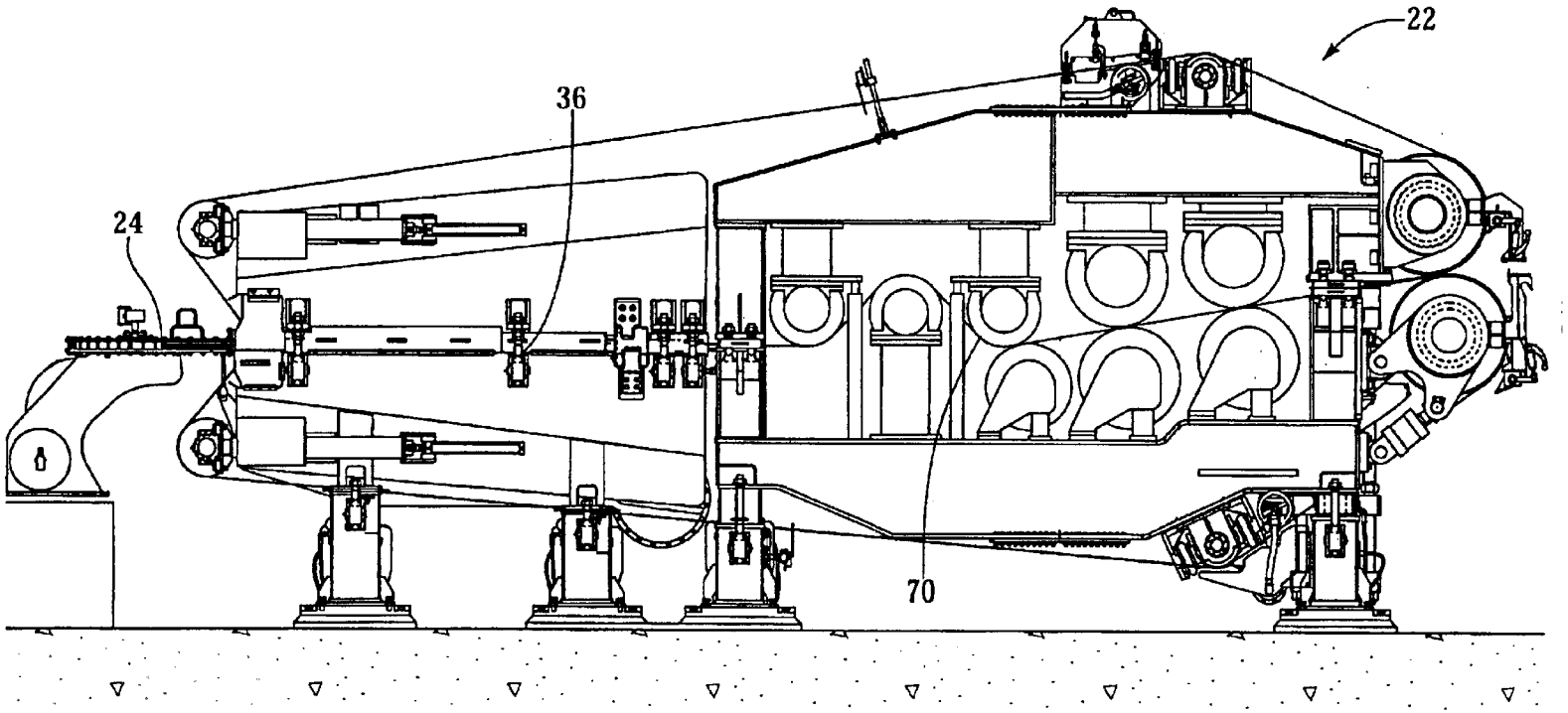
FIG. 1 is side elevational schematic view of a pulp former of this invention.

Referring more particularly to FIGS. 1–5, wherein like numbers refer to similar parts, a twin wire pulp former 22 is shown in FIG. 1. The pulp former 22 has a headbox 24 with a slice 26, shown in FIG. 4, which injects a stream of pulp with a consistency of about four percent between an upper forming fabric 28, and a lower forming fabric 30. The upper forming fabric 28 turns around the upper forming shoe 32 and forms an endless loop about the forming shoe 32. The lower forming fabric 30 turns around the lower forming shoe 34 forming an endless loop about the lower forming shoe 34. The forming fabrics 28, 30 form a twin wire run which travels through a table section 36 of the pulp former 22. The pulp mat or web is dewatered to a fiber content of 45 to 50 percent leaving the pulp former to be formed into bales for shipping.

Figure 3:
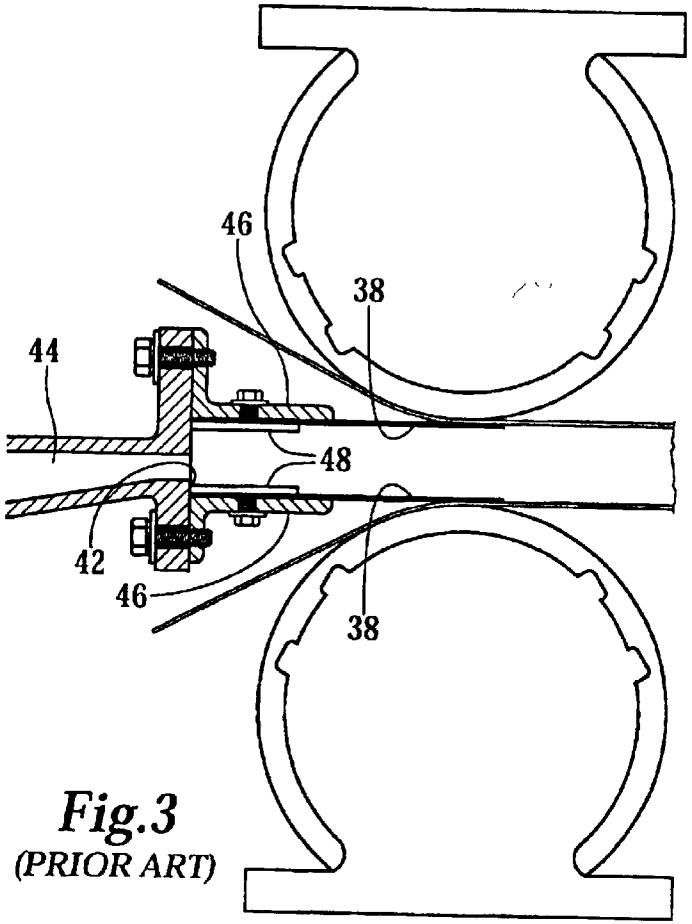
Fig.3 (PRIOR ART)
FIG. 3 is a schematic fragmentary side elevational view of a prior art forming section showing how prior art flexible sealing blades were mounted to the lips of a pulp former headbox.

FIG. 3 shows a prior art method of attaching flexible stainless steel blades 38 to the lips 42 of the prior art slice 44. The flexible stainless steel blades 38 are mounted to blade supports 46 by holders 48 on the pulp side of the flexible blades 38. The prior art method of attachment places the holders 48 within the stream of pulp being formed. This is undesirable.

Figure 2:
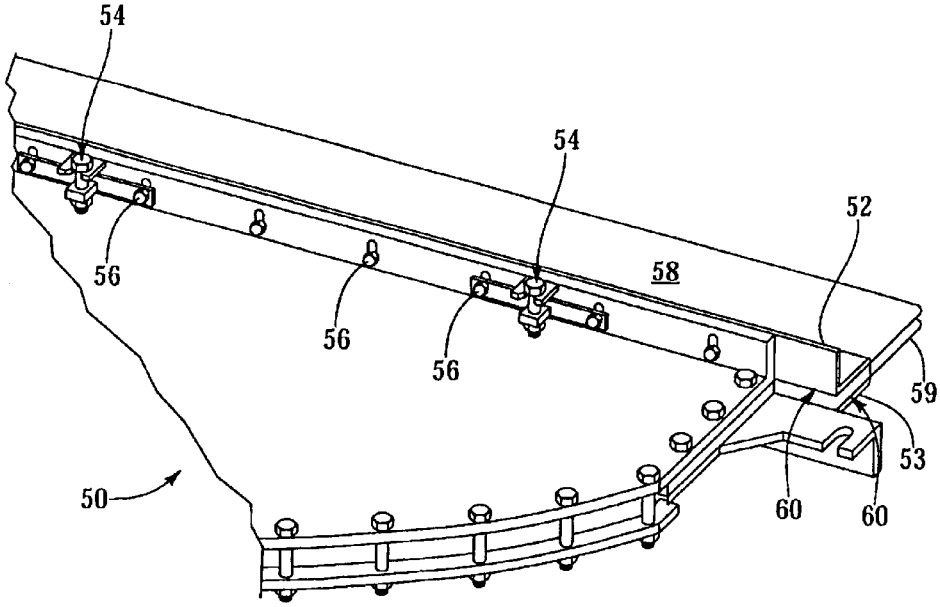
FIG. 2 is a fragmentary isometric view of the headbox and the mounting of the flexible sealing blades of the pulp former of FIG. 1.
Figure 4:
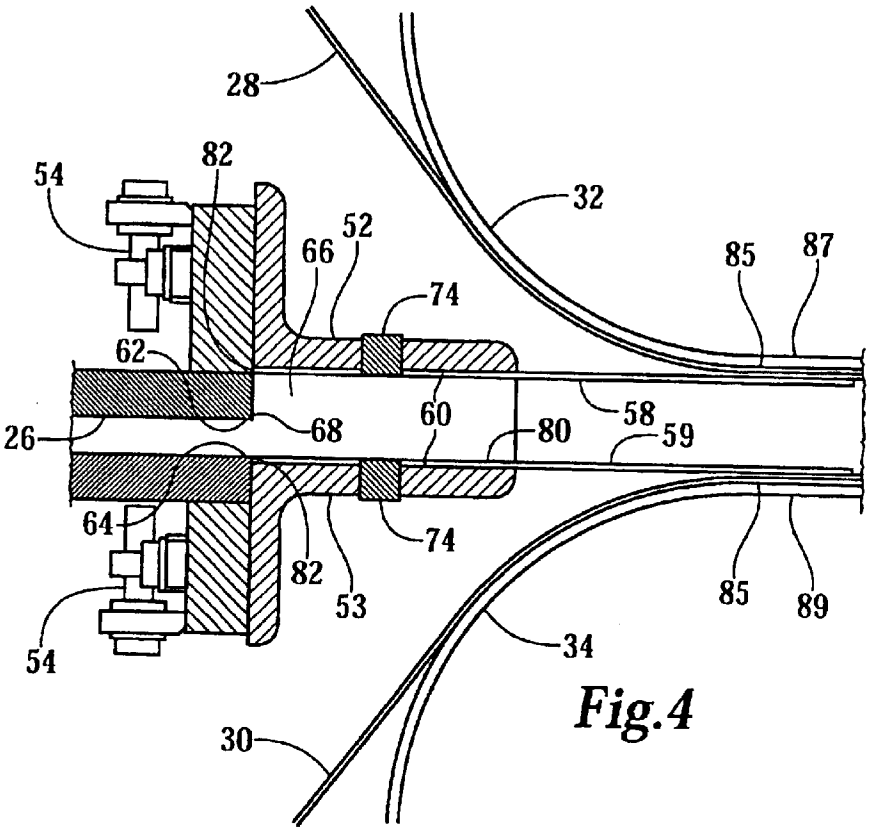
FIG. 4 is a side elevational fragmentary view of the forming section of the pulp former of FIG. 1 showing how flexible sealing blades are mounted to the lips of the pulp former headbox of FIG. 1.

FIG. 2 shows a headbox 50 to which are mounted two adjustable blade holders 52 which can be adjusted by means of adjustment mechanisms 54, and clamped in place by means of bolts 56. Flexible stainless steel blades 58, 59 extend in the cross machine direction and in the machine direction and are mounted to the pulp facing sides 60 of the blade holders 52, 53, as shown in FIG. 4. The adjustment mechanisms 54 are mounted to the upper slice lip 62 and the lower slice lip 64. The stock flow channel 66 abruptly increases in height as it crosses the threshold 68 of the slice lips 62, 64. This abrupt change produces turbulence which fluidizes the high consistency pulp used in the pulp former 22. Pressure within the stock flow channel 66 pushes the blades shown in FIG. 4 against the upper and lower forming fabrics 28, 30. Pressure within the flow channel 66 seals the flexible blades 58, 59 to the forming fabrics 28, 30.

A prior art former (not shown) has the flexible sealing blades which are welded to an adjustable blade holder, such as shown in FIG. 2. However, distortion due to the heating caused by welding can lead to distortion of the blades which can lead to the leaking of pulp around the blades. The pulp leaks are undesirable because the leaking pulp forms clumps which are dragged into the former by the moving wires causing an uneven pulp mat to form which may damage, or produce undesirable wear in the pressing section 70 of a pulp former 22.

Figure 5:
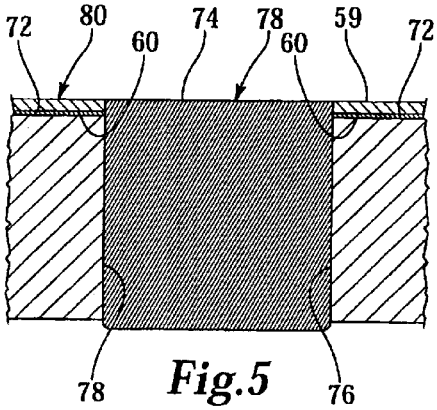
FIG. 5 is an enlarged fragmentary cross-sectional view of the attachment of the flexible sealing blades of FIG. 1 to the sealing blade support.

As shown in FIGS. 4 and 5, the flexible blades 58, 59 are attached to the pulp facing sides 60 of the blade holders 52, 53 by an adhesive bond 72 formed of any suitable adhesive such as Loctite® adhesives, available from Loctite Corp., of Rocky Hill, Conn. In addition to being bonded, the flexible blades 58, 59 are attached by pins 74 which are press fit or bonded within the holes 76 drilled through the blades 58, 59 and the blade holders 52, 53. The pins 74, as shown in FIG. 5, have pulp side faces 78 which are flush with the pulp side faces 80 of the flexible blades 58, 59. The pins 74 are arrayed in the cross machine direction and may be arranged in a straight line or may be staggered. The pins 74 are spaced at a suitable distance, for example four or six inches apart in the cross machine direction. The pins 74 help to limit the load which is applied to the bond or layer 72 as they function to significantly limit any shearing action between the flexible blades 58, 59 and the blade holders 52, 53.

The back sides 82 of the blades 58, 59 abut against the upper and lower slice lips 62, 64 so that they do not interfere with the flow of stock between the headbox 50 and the gap between the upper and lower forming fabrics 28, 30.

As shown in FIG. 4 the upper forming fabric 28 passes around an upper forming shoe 32, and the lower forming fabric 30 passes over a lower forming shoe 34. The upper forming fabric 28 and lower forming fabric 30 as they pass about the forming shoes 32, 34 form a joint run 85, and the headbox 24 is positioned to inject high consistency stock into the joint run 85. As shown in FIG. 4, the flexible stainless steel blades 58, 59 extend parallel to an overlap parallel portions 87, 89 of the forming shoes 32, 34

Figure 6:
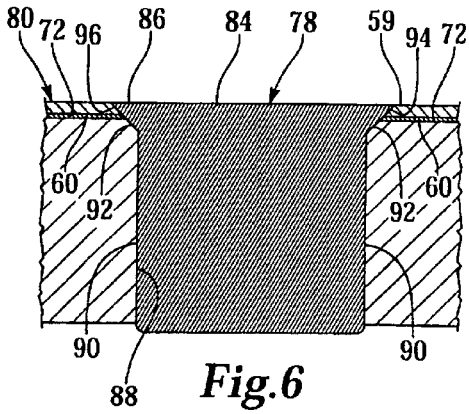
FIG. 6 is an enlarged fragmentary cross-sectional view of an alternative embodiment attachment of the flexible sealing blades of this invention to the sealing support.

An alternative embodiment attachment pin 84 is shown in FIG. 6. The pin 84 has a countersink head 86, formed by a conical extension of the cylindrical body 88 of the pin 84. The hole 90 which receives the pin 84 has a countersunk portion 92 which corresponds to the countersink head 86. The hole 94 in the blade 59 also has a countersunk portion 96. The alternative embodiment pin 84 fixes the flexible stainless steel blades 58, 59 against pealing or lifting forces such as might be produced by cavitation between the blade holders 52, 53.

In the formation of a pulp mat or web in a pulp former 22 to achieve a uniform web, which may be for example 150 inches wide, it is necessary to keep the high consistency pulp fluid until the pulp mat is formed. This is accomplished by high velocity flow and induced turbulence. There is a tendency for clumps of fibers to form about discontinuities or where leaks occur. These fiber clumps build up before flowing downstream into the forming pulp mat. Such clumps can interfere with the dewatering which occurs in the pulp former 22 as well as damage the press roll covers due to excessive pressure. It will thus be understood the importance of attaching the flexible stainless steel blades 58, 59 which extend between the slice lips 62, 64 so that leaking of pulp fiber is avoided, while at the same time sites where fibers may build up are avoided. In particular it will be desirable that the top surfaces 78 of the pins 74, 84 are flush with the pulp side faces 80 of the flexible blades 58, 59.

It should be understood that the flexible blades 58, 59 may be pinned to the blade holders 52, 53 in addition to the adhesive bonding or as a substitute for the adhesive bonding.

It is understood that the invention is not limited to the particular construction and arrangement of parts herein illustrated and described, but embraces all such modified forms thereof as come within the scope of the following claims.

I claim:

1. A pulp former comprising:

the pulp former having a headbox having an upper slice lip and a lower slice lip;

an upper forming fabric forming a first endless loop;

a lower forming fabric forming a second endless loop;

wherein the upper forming fabric and the lower forming fabric define a joint run, and wherein the headbox is positioned to inject high consistency stock into the joint run;

a first blade holder mounted to the upper slice lip and having a substantially planar first pulp facing surface;

a second blade holder mounted to the lower slice lip and having a substantially planar second pulp facing surface which is parallel to the first pulp facing surface;

a first flexible blade which extends between the first blade holder and the first forming fabric, an adhesive bond formed between the first flexible blade and the first blade holder first pulp facing surface;

a second flexible blade which extends between the second blade holder and the second forming fabric, and an adhesive bonding between the second flexible blade and the second blade holder second pulp facing surface.

2. The pulp former of claim 1 further comprising first pins which extend perpendicularly through the first flexible blade and the first blade holder, and wherein the first flexible blade defines a first pulp engaging surface, and wherein the first pins are mounted substantially flush with the pulp engaging surface.

3. The pulp former of claim 2 further comprising second pins which extend perpendicularly through the second flexible blade and the second blade holder, and wherein the second flexible blade defines a second pulp engaging surface, and wherein the second pins are mounted substantially flush with the second pulp engaging surface.

4. The pulp former of claim 2 wherein the first pins have tapered portions which extend radially outwardly and upwardly forming conical surfaces, and wherein at least the first flexible blade has portions forming conical countersunk portions which engage with the tapered portions of the first pins.

5. The pulp former of claim 4 wherein the first blade holder also has portions forming conical countersunk portions which engage with the tapered portions of the first pins.

6. A pulp former comprising:

the pulp former having a headbox having an upper slice lip and a lower slice lip;

an upper forming fabric forming a first endless loop;

a lower forming fabric forming a second endless loop; and wherein the upper forming fabric and the lower forming fabric define a joint run, and wherein the headbox is positioned to inject high consistency stock into the joint run formed between the first forming fabric and the second forming fabric;

a first blade holder mounted to the upper slice lip and having a substantially planar first pulp facing surface;

a second blade holder mounted to the lower slice lip and having a substantially planar second pulp facing surface which is parallel to the first pulp facing surface;

a first flexible blade which extends between the first blade holder and the first forming fabric, the first flexible blade being mounted to the first blade holder by first pins which extend through the first flexible blade and the first blade holder; and a second flexible blade which extends between the second blade holder and the second forming fabric, the second flexible blade being mounted to the first holder by pins which extend through the second flexible blade and the second blade holder.

7. The pulp former of claim 6 further comprising an adhesive bonding between the first flexible blade and the first blade holder.

8. The pulp former of claim 7 further comprising an adhesive bonding between the second flexible blade and the second blade holder.

9. The pulp former of claim 6 wherein the first pins have tapered portions which extend radially outwardly and upwardly forming conical surfaces, and wherein at least the first flexible blade has portions forming conical countersunk portions which engage with the tapered portions of the first pins.

10. The pulp former of claim 9 wherein the first blade holder also has portions forming conical countersunk portions which engage with the tapered portions of the first pins.

11. A method of attaching flexible blades to the lips of a pulp former, having a first blade holder mounted to an upper slice lip and having a substantially planar first pulp facing surface; a second blade holder mounted to a lower slice lip and having a substantially planar second pulp facing surface which is parallel to the first pulp facing surface; the method comprising the steps of:

bonding with an adhesive a first flexible blade to the first pulp facing surface of a first adjustable blade holder;

forming holes which pass through a portion of the first flexible blade and into a portion of the first adjustable blade bolder;

pinning the first flexible blade to the adjustable blade holder by passing pins through the portion of the first flexible blade and the portion of the first adjustable blade holder;

bonding with an adhesive a second flexible blade to the second pulp facing surface of a second adjustable blade holder;

forming holes which pass through a portion of the second flexible blade and into a portion of the second adjustable blade holder; and pinning the second flexible blade to the adjustable blade holder by passing pins through the portion of a second flexible blade and the portion of the second adjustable blade holder.

* * * * *